US011891229B1

(12) United States Patent
Madigan, Jr.

(10) Patent No.: US 11,891,229 B1
(45) Date of Patent: Feb. 6, 2024

(54) TEMPERATURE-CONTROLLED CONTAINER

(71) Applicant: Richard J. Madigan, Jr., Hingham, MA (US)

(72) Inventor: Richard J. Madigan, Jr., Hingham, MA (US)

(73) Assignee: Accutech Packaging, Inc., Foxboro, MA (US)

( * ) Notice: Subject to any disclaimer, the term of this patent is extended or adjusted under 35 U.S.C. 154(b) by 317 days.

(21) Appl. No.: 17/329,597

(22) Filed: May 25, 2021

(51) Int. Cl.
*B65D 81/38* (2006.01)
*B65D 77/04* (2006.01)

(52) U.S. Cl.
CPC ..... *B65D 81/3834* (2013.01); *B65D 77/042* (2013.01); *B65D 2577/041* (2013.01)

(58) Field of Classification Search
CPC ..... B65D 81/3834; B65D 81/3858; B65D 81/3846; B65D 81/3853; B65D 77/042; B65D 77/0433; B65D 2577/041
See application file for complete search history.

(56) References Cited

U.S. PATENT DOCUMENTS

| | | | |
|---|---|---|---|
| 7,469,549 | B2 | 12/2008 | Ahlberg |
| 8,367,180 | B2 | 2/2013 | Roberts |
| 8,453,477 | B2 | 6/2013 | Crespo et al. |
| 8,962,706 | B2 | 2/2015 | Pawloski et al. |
| 9,139,319 | B2 | 9/2015 | Crespo et al. |
| 9,988,175 | B2 | 6/2018 | Hasan et al. |
| 10,089,594 | B2 | 10/2018 | Gray |
| 10,518,444 | B2 | 12/2019 | Pawloski et al. |
| 10,605,674 | B1 | 3/2020 | Holbrook et al. |
| D888,278 | S | 6/2020 | Madigan et al. |
| 10,688,698 | B2 | 6/2020 | Bhargava et al. |
| D915,160 | S | 4/2021 | Madigan et al. |
| 10,988,302 | B1 | 4/2021 | Madigan et al. |
| D918,414 | S | 5/2021 | Madigan et al. |
| 2011/0024433 | A1* | 2/2011 | Rolland ..... B32B 13/12 220/592.2 |
| 2020/0148453 | A1* | 5/2020 | Sollie ..... B65D 5/4295 |

* cited by examiner

*Primary Examiner* — Andrew T Kirsch
(74) *Attorney, Agent, or Firm* — Salter & Michaelson

(57) ABSTRACT

A temperature-controlled container that includes an outer box structure that defines an inner cavity; an inner box structure that is constructed and arranged for engagement into the cavity that is formed in the outer box structure; said inner box structure having an open passage for accommodating an item the temperature of which is to be controlled, and a wheat straw material that is disposed in the outer box structure between respective sidewalls of the outer box structure and the inner box structure, and that is disposed in the open space between a bottom of the inner box structure and a bottom of the outer box structure. The inner box structure has a height that is less than a height of the outer box structure so as to define an open space between a bottom of the inner box structure and a bottom of the outer box structure. An insert that is constructed and arranged for insertion into the open passage and over the item the temperature of which is to be controlled.

20 Claims, 22 Drawing Sheets

TEMPERATURE-CONTROLLED CONTAINER

FIELD OF THE INVENTION

The present invention relates in general to an improvement in a temperature-controlled container or cooler. More particularly, the present invention relates to a temperature-controlled container or cooler that is effective in maintaining a desired temperature range for an item the temperature of which is being controlled.

BACKGROUND OF THE INVENTION

The majority of existing coolers are EPS (expanded polystyrene) coolers. One of the problems associated with these types of coolers is that the material is not readily biodegradable and, furthermore, is not completely effective in providing a sustainable shipping container.

Accordingly, it is an object of the present invention to provide an improved temperature controlling container or cooler that contains an insulating material that is readily biodegradable.

Another object of the present invention is to provide an improved temperature-controlled container or cooler that utilizes a completely compostable material; preferably wheat straw.

Still another object of the present invention is to provide an improved temperature-controlled container or cooler in which the item, the temperature of which is being controlled, is completely encapsulated with preferably no air gaps.

SUMMARY OF THE INVENTION

To accomplish the foregoing and other objects of the present invention there is provided a temperature-controlled container comprising:

an outer box structure that defines an inner cavity;

an inner box structure that is constructed and arranged for engagement into the cavity that is formed in the outer box structure;

said inner box structure having an open passage for accommodating an item the temperature of which is to be controlled;

said inner box structure having a height that is less than a height of the outer box structure so as to define an open space between a bottom of the inner box structure and a bottom of the outer box structure;

a wheat straw material that is disposed in the outer box structure between respective sidewalls of the outer box structure and the inner box structure, and that is disposed in the open space between a bottom of the inner box structure and a bottom of the outer box structure.

In accordance with other aspects of the present invention the outer box structure is in the form of a hexahedron and has a pair of opposed flaps; the inner box structure is in the form of a hexahedron and has four flaps; the pair of opposed flaps of the outer box structure are closed against a top of the outer box structure that defines the cavity; the four flaps of the inner box structure are disposed in two opposed sets that are foldable against and sealed with the top of the outer box structure that defines the cavity; further including an insert that is constructed and arranged for insertion into the open passage and over the item the temperature of which is to be controlled; wherein the insert is hollow and contains an amount of wheat straw; and wherein the insert fits within the open passage with a tight but slidable fit so as to be adjustable in position relative to the item the temperature of which is to be controlled.

In accordance with another version of the present invention there is provided a temperature-controlled container comprising:

an outer box structure that includes a top wall that defines an inner cavity;

an inner box structure that is constructed and arranged for engagement into the cavity that is formed in the top wall of the outer box structure;

said inner box structure having a series of top folds that are bendable for securing to the top wall of the outer box structure;

said inner box structure having an open passage for accommodating an item the temperature of which is to be controlled;

said inner box structure having a height that is less than a height of the outer box structure so as to define an open space between a bottom of the inner box structure and a bottom of the outer box structure;

a wheat straw material that is disposed in the outer box structure between respective sidewalls of the outer box structure and the inner box structure, and that is disposed in the open space between a bottom of the inner box structure and a bottom of the outer box structure;

an insert that is constructed and arranged for insertion into the open passage and over the item the temperature of which is to be controlled;

wherein the insert is hollow and contains an amount of wheat straw; and wherein the insert fits within the open passage with a tight but slidable fit so as to be adjustable in position relative to the item the temperature of which is to be controlled.

In accordance with other aspects of the present invention the outer box structure is in the form of a hexahedron and has a pair of opposed flaps; the pair of opposed flaps of the outer box structure are closed against a top of the outer box structure that defines the cavity; the four flaps of the inner box structure are disposed in two opposed sets that are foldable against and sealed with the top of the outer box structure that defines the cavity; and the insert has a top loop useable in handling the insert.

In accordance with still another version of the present invention there is provided a method of packaging an item the temperature of which is to be controlled using a temperature-controlled container comprising the steps of:

providing an outer box structure that includes a top wall that in part defines an inner cavity;

providing an inner box;

engaging the inner box structure for engagement into the cavity that is formed in top wall of the outer box structure;

said inner box structure having an open passage for accommodating the item the temperature of which is to be controlled;

said inner box structure having a height that is less than a height of the outer box structure so as to define an open space between a bottom of the inner box structure and a bottom of the outer box structure; and filling wheat straw material into the container and that is disposed in the outer box structure between respective sidewalls of the outer box structure and the inner box structure, and that is disposed in the open space between a bottom of the inner box structure and a bottom of the outer box structure.

In accordance with still other aspects of the method of the present invention including providing an insert that is constructed and arranged for insertion into the open passage and over the item the temperature of which is to be controlled; wherein the insert is hollow and filling an amount of wheat straw into the insert; including fitting the insert within the open passage with a tight but slidable fit so as to be adjustable in position relative to the item the temperature of which is to be controlled; wherein the outer box structure is in the form of a hexahedron and has a pair of opposed flaps, and wherein the pair of opposed flaps of the outer box structure are closed against a top of the outer box structure that defines the cavity.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Figure 19:
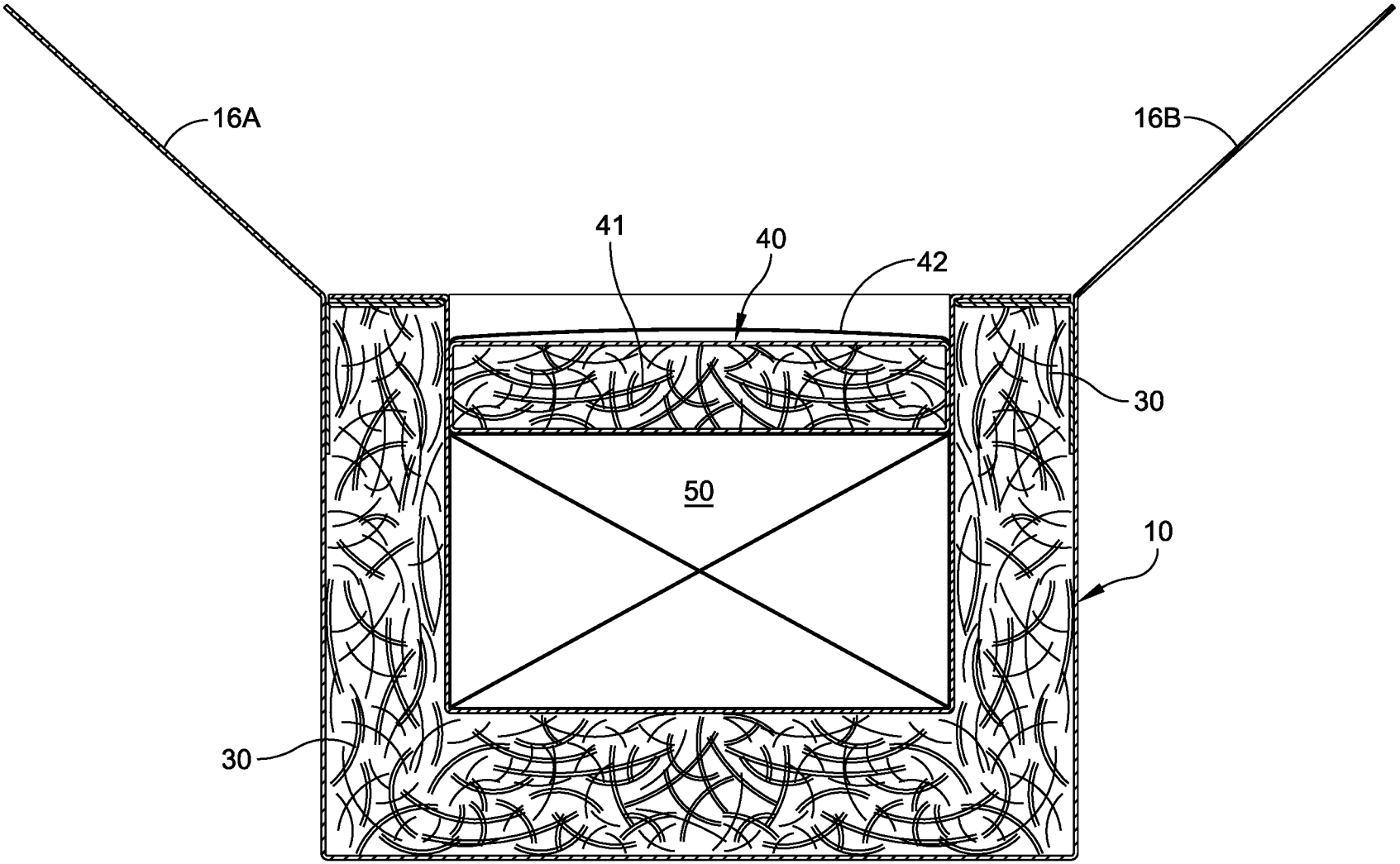
FIG. 19 is a cross-sectional view similar to that shown in FIG. 18 for a particular size of an item, the temperature of which is to be controlled.
Figure 20:
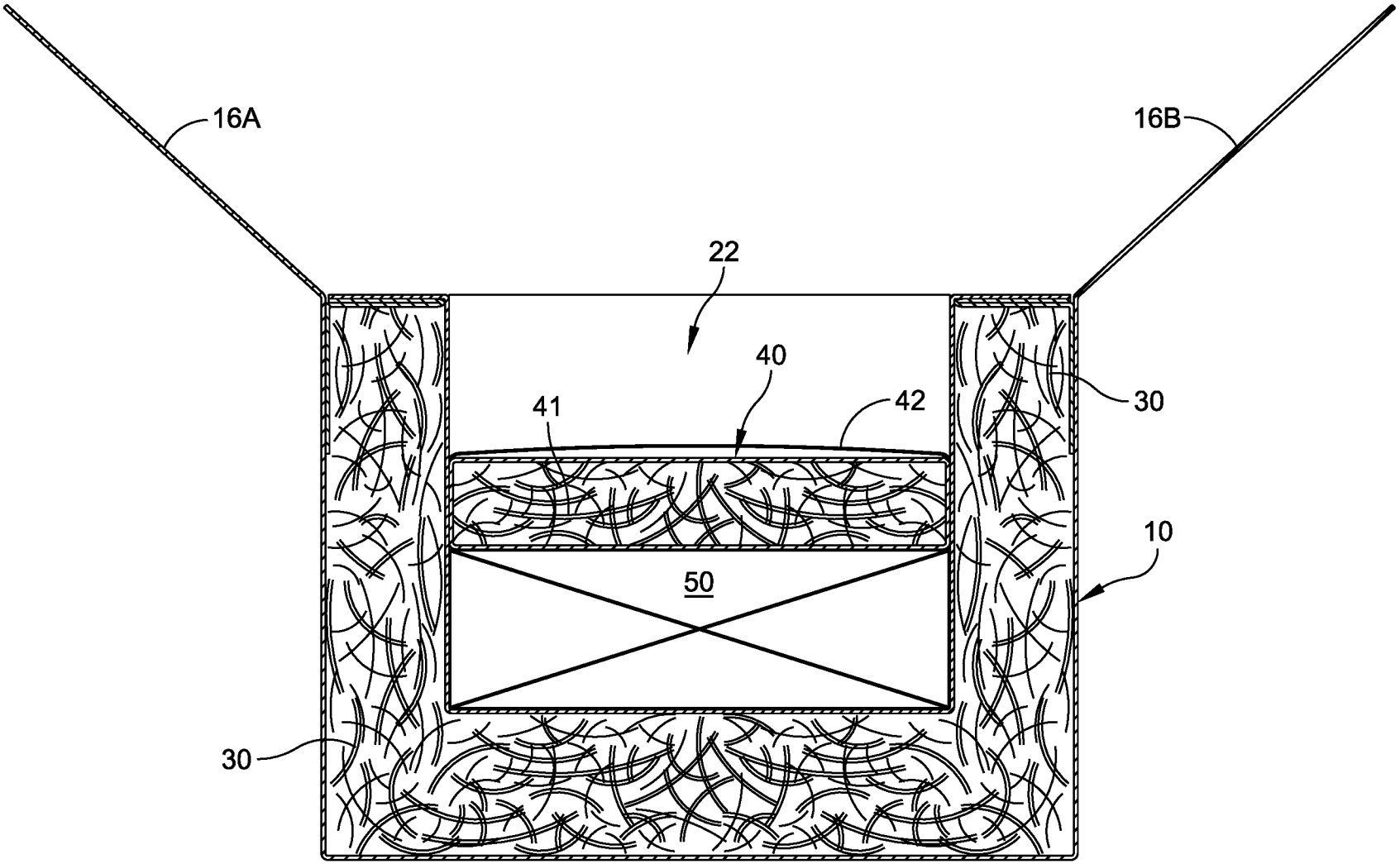
FIG. 20 is a cross-sectional view similar to that in FIGS. 18 and 19 but illustrating the position of the insert relative to a smaller item.
Figure 21:
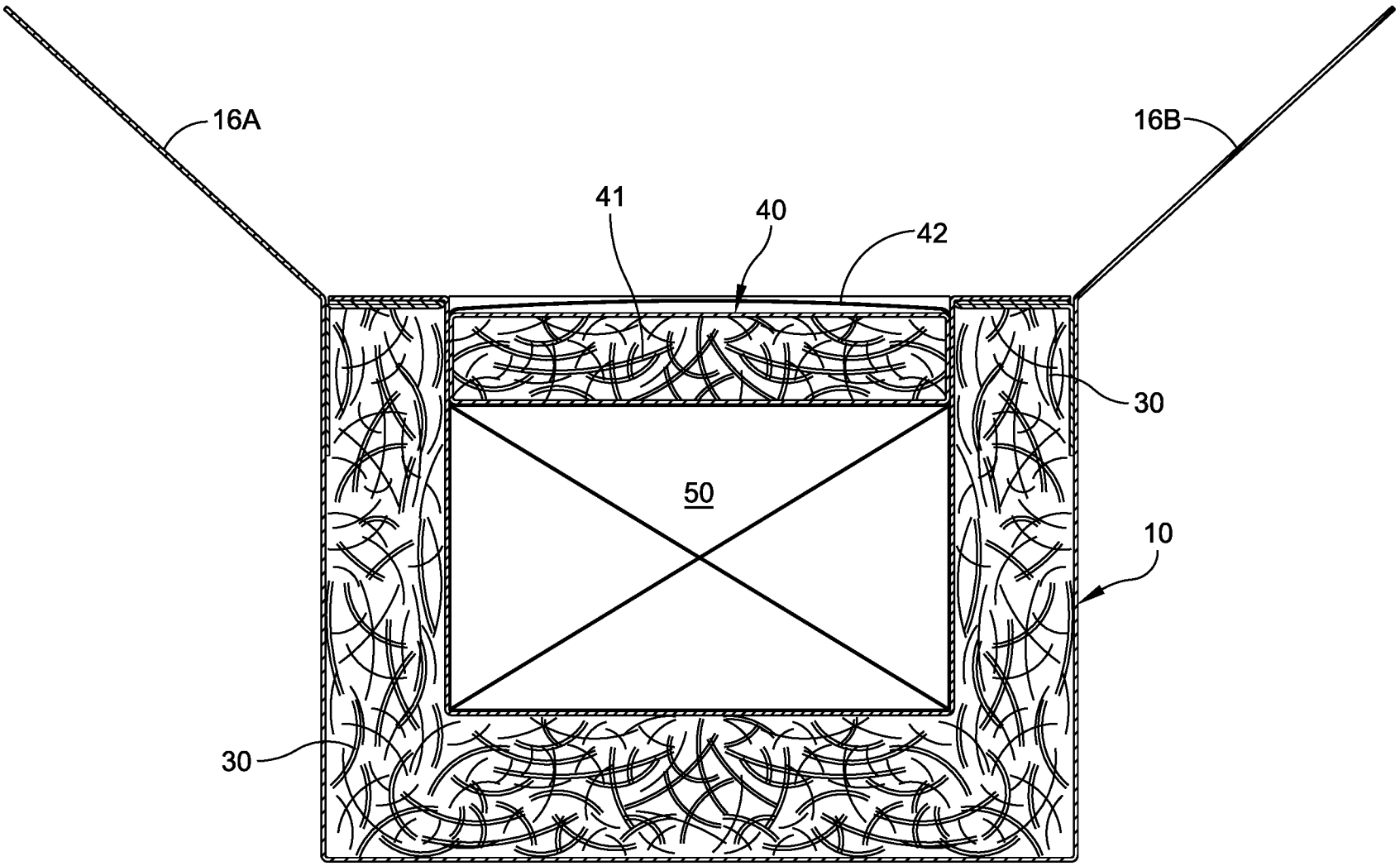
FIG. 21 is a cross-sectional view similar to that in FIGS. 18 and 19 but illustrating the position of the insert relative to a larger item.

Reference is now made to the drawings for a preferred embodiment of the present invention. The container of the present invention relies upon a box-in-box structure that provides complete encapsulation of insulation about the item. In accordance with the present invention there are no air gaps and there is consistent insulation in all areas of the container. The insert provides the ability to adjust interior dimensions to accommodate multiple payload sizes such as illustrated in FIGS. 19-21. The result is increased performance by eliminating virtually all air gaps. Air gaps tend to cause a deterioration of the product in cold chain applications. Furthermore, the variable depth insert allows for the adjustment of height and thus protects the payload from shifting in transit which may cause damage. In accordance with the present invention, the preferred insulation is a wheat straw. This has the advantage of making the interior of the container compostable while yet performing as well as standard EPS coolers as far as temperature control and sustainability is concerned. The structure of the wheat straw provides for critical containment of air within the insulation area.

Again, with reference to the drawings, which include FIGS. 1-23, there is illustrated a container or cooler that is comprised of an outer box structure 10. This structure may be constructed of a standard cardboard material and, as illustrated in FIGS. 2-5, has opposed flaps 16A, 16B and 18A, 18B that together define a square opening referred to herein as defining a cavity 14 (see FIG. 5). The cavity will receive the outer box structure 20 as described hereinafter in the description.

Figure 1:
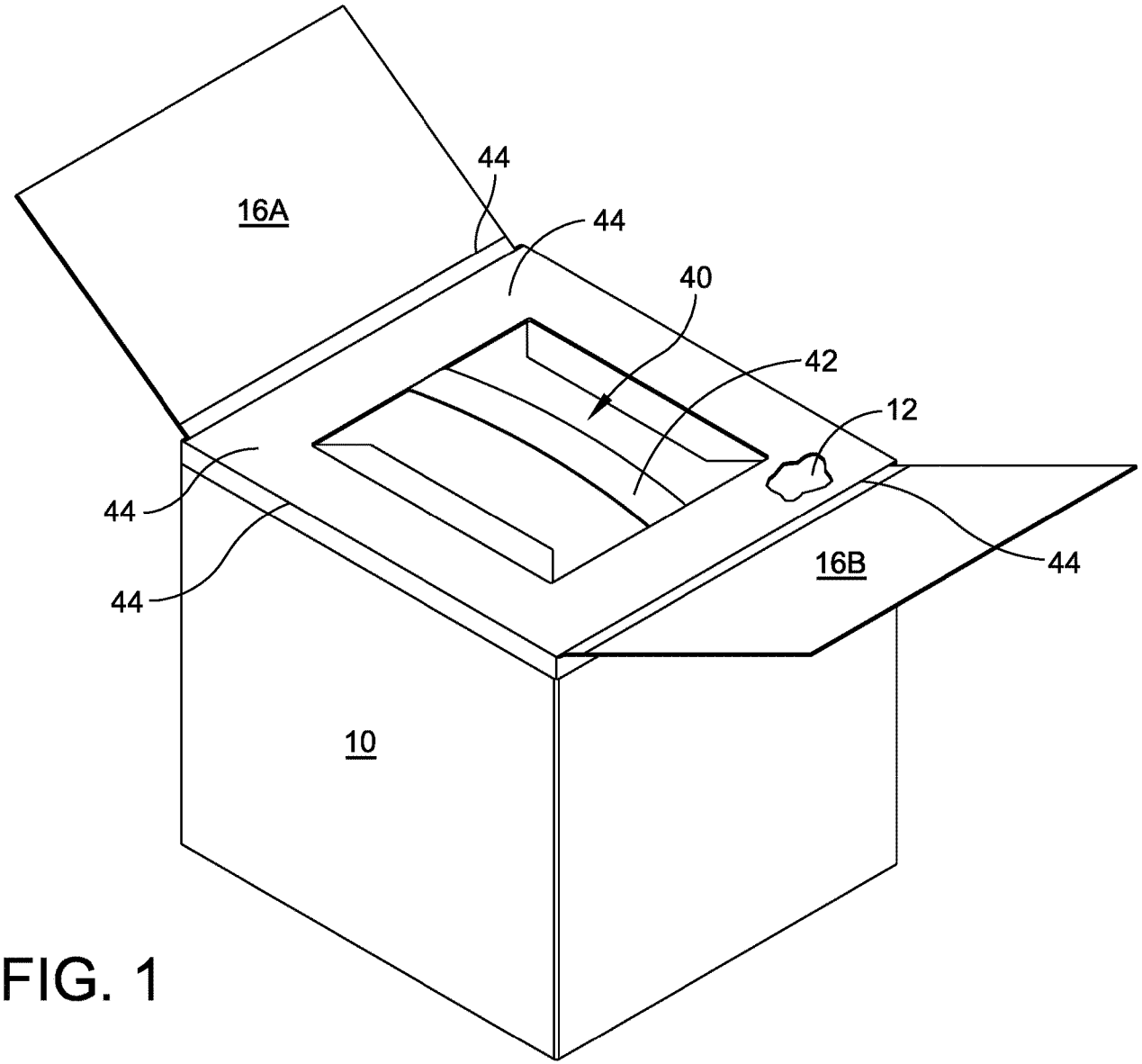
FIG. 1 is a perspective view of the temperature-controlled container in a finally assembled state.
Figure 2:
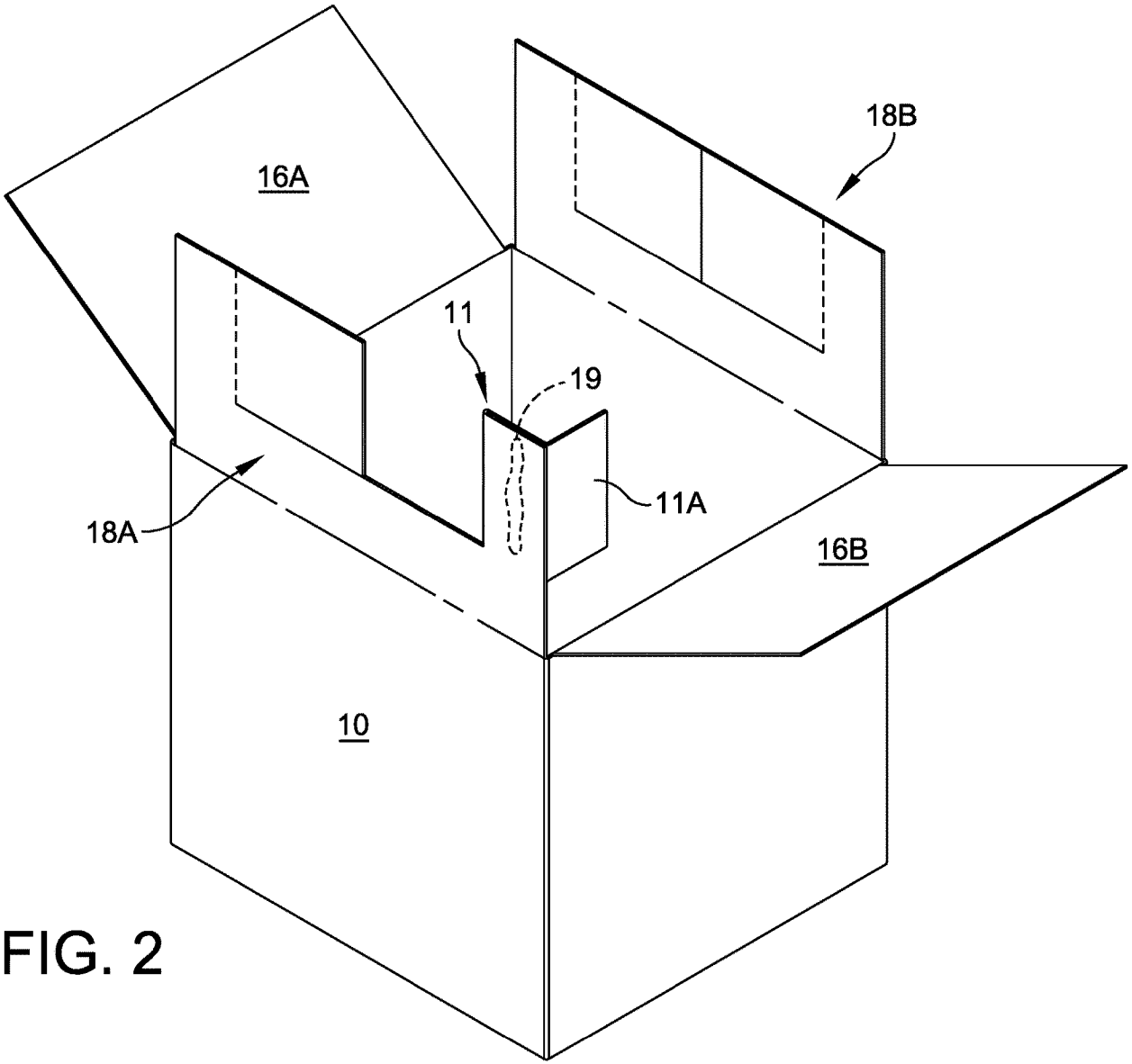
FIG. 2 is a perspective view of the outer box structure with the folds in a first position.
Figure 3:
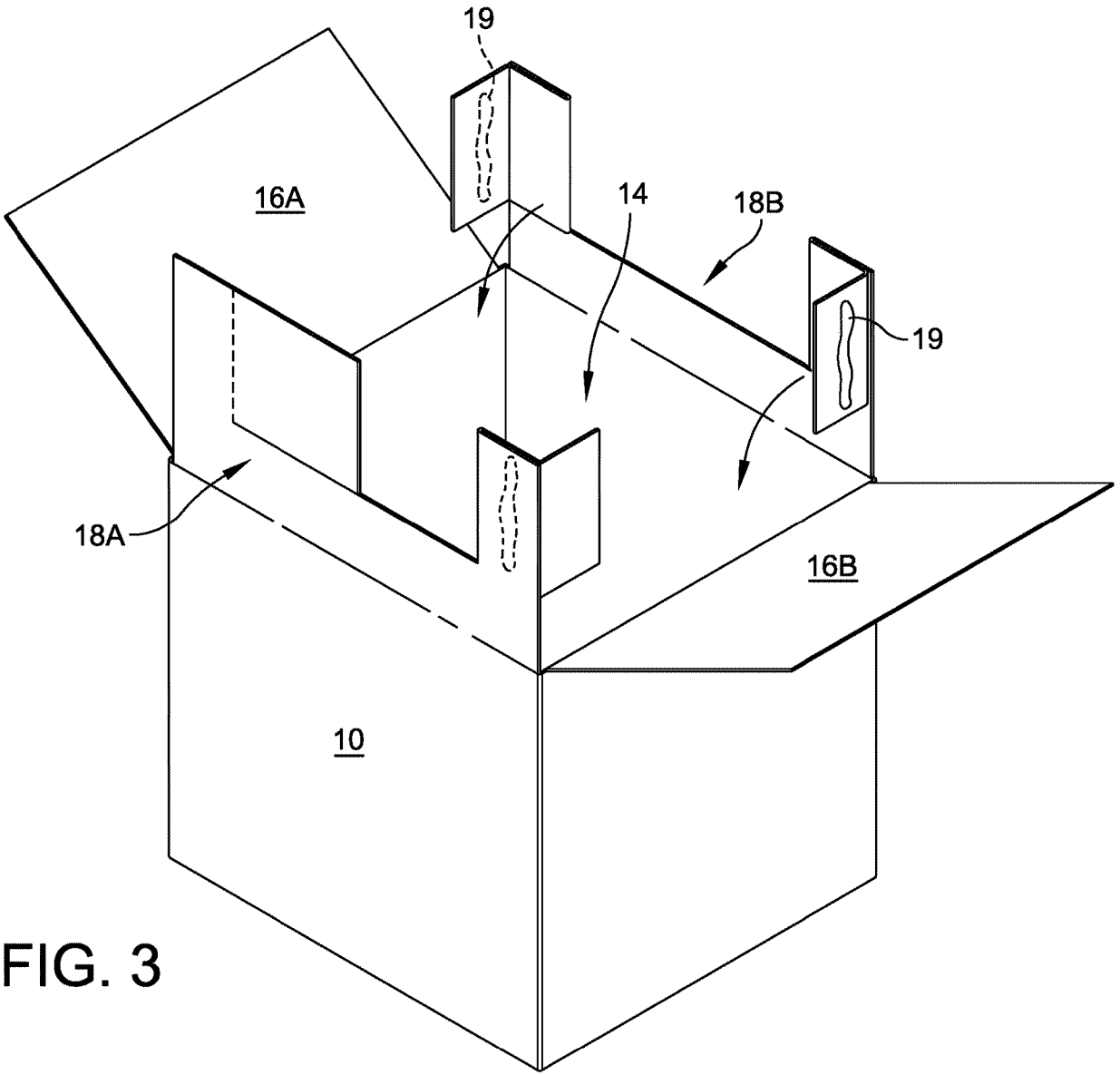
FIG. 3 is a perspective view related to FIG. 2 and illustrating a further folding step.
Figure 4:
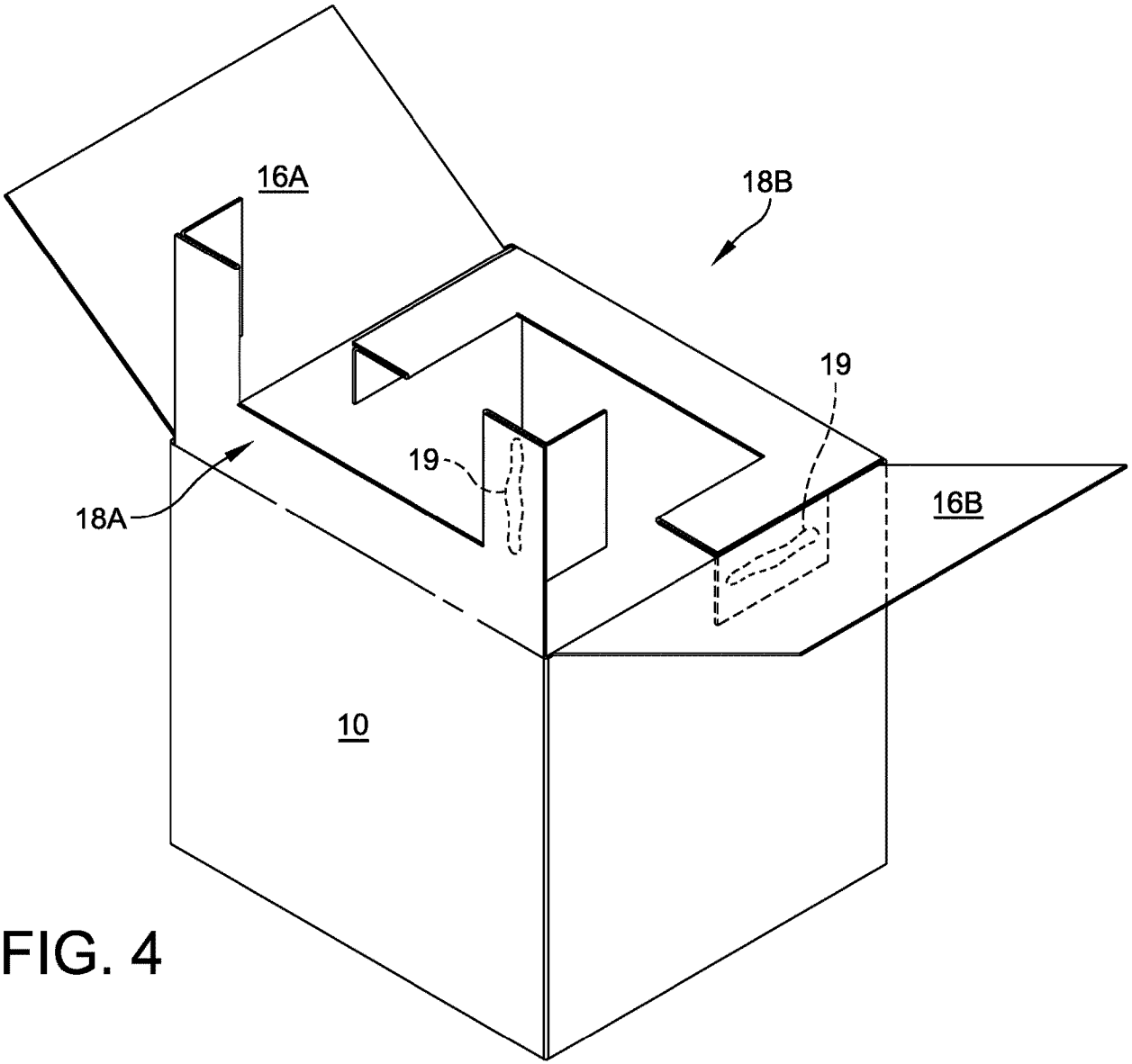
FIG. 4 is a perspective view related to FIGS. 2 and 3 and illustrating still a further folding step.
Figure 5:
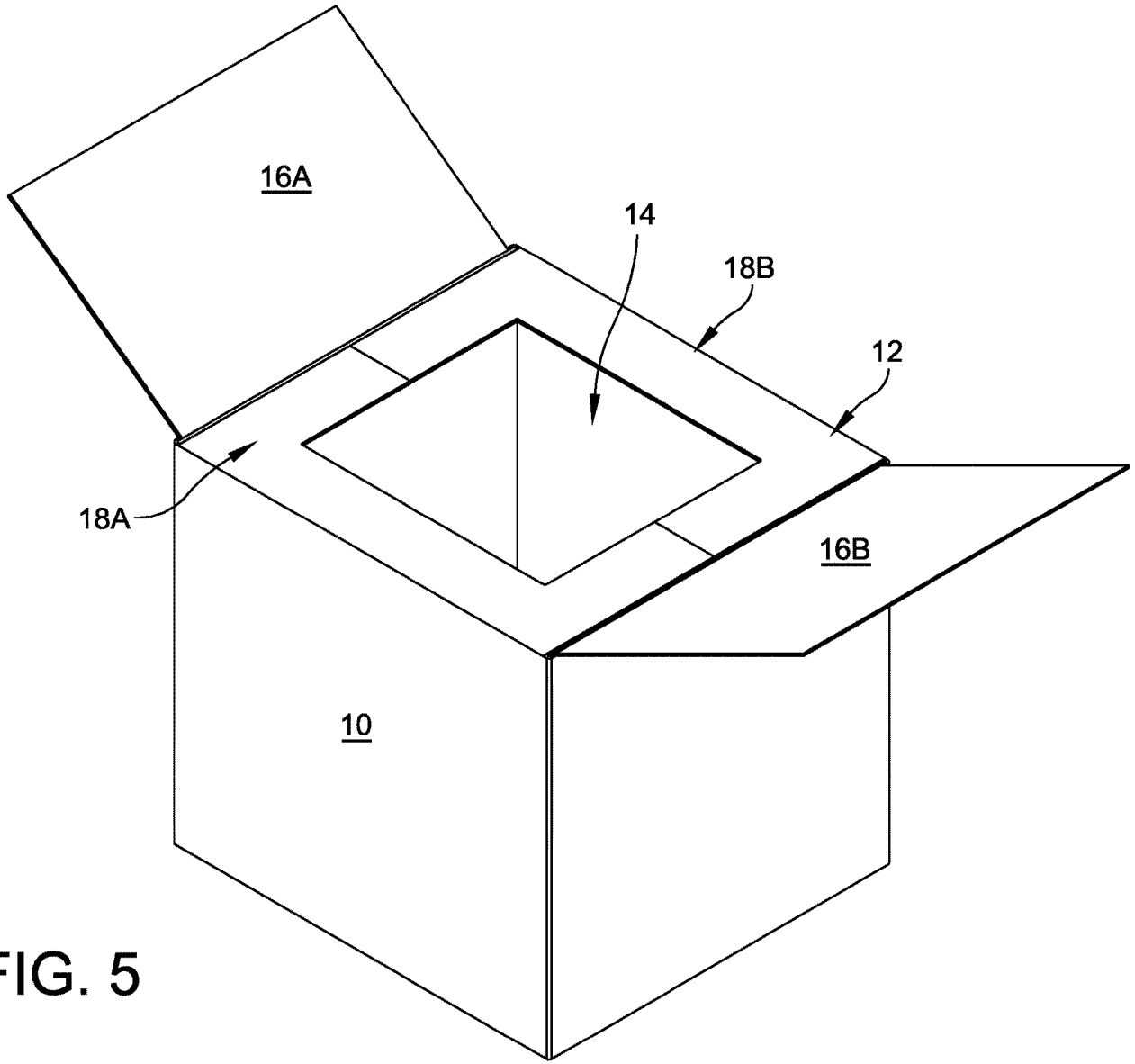
FIG. 5 is a perspective view showing the outer box structure assembled with a top wall defining an inner cavity.

As indicated previously, FIG. 1 shows the final assembled cooler where there are depictions of tape at several location indicated at 44 in the drawing. The tape 44 provides a complete seal with no air gaps. The sequence of FIGS. 2-4 illustrate the manner in which the opposed side flaps 18A and 18B are separated and folded upon each other with the use of glue spots at 19. FIG. 2 illustrates one fold 11 doubled over so as to provide a side tab 11A. FIG. 3 shows the folding arrangement for both the side flaps 18A and 18B. Corresponding side tabs are provided in order to secure the folds 18A, 18B to respective inner surfaces of the box structure sidewalls. FIG. 4 illustrates one of the folds being attached to an inner surface of a side wall of the outer box structure with the use of an adhesive spot, as shown at 19 in FIG. 4. FIG. 5 illustrates the finally assembled inner box structure that includes a top wall 12 defining an open cavity 14 in which will be inserted the inner box structure. The top wall 12 is essentially formed by the folded over folds 18A and 18B. FIG. 5 also illustrates the opposed flaps 16A and 16B. With respect to the bottom view of FIG. 11, the outer box structure also has four bottom flaps 17 that, in the finished product, are folded inward and sealed so that the entire bottom wall has no air gaps.

Figure 7:
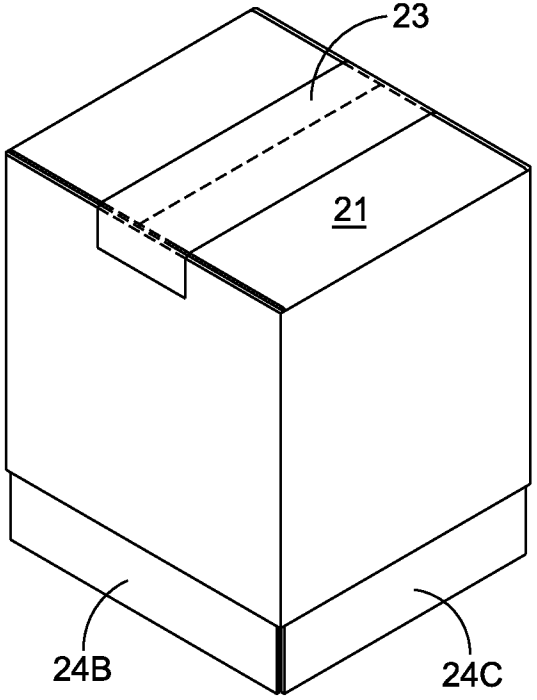
FIG. 7 is a bottom view of the inner box structure.
Figure 6:
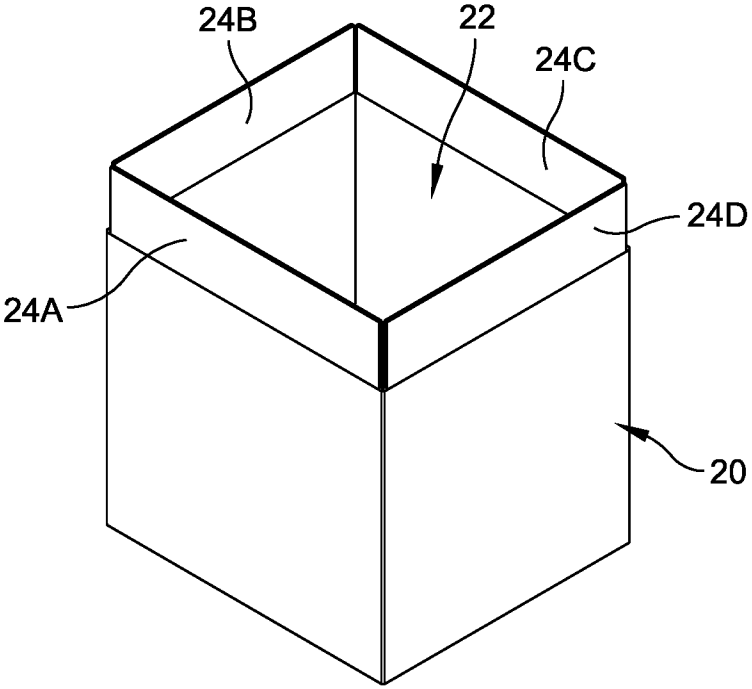
FIG. 6 is a top perspective view of the inner box structure.
Figure 8:
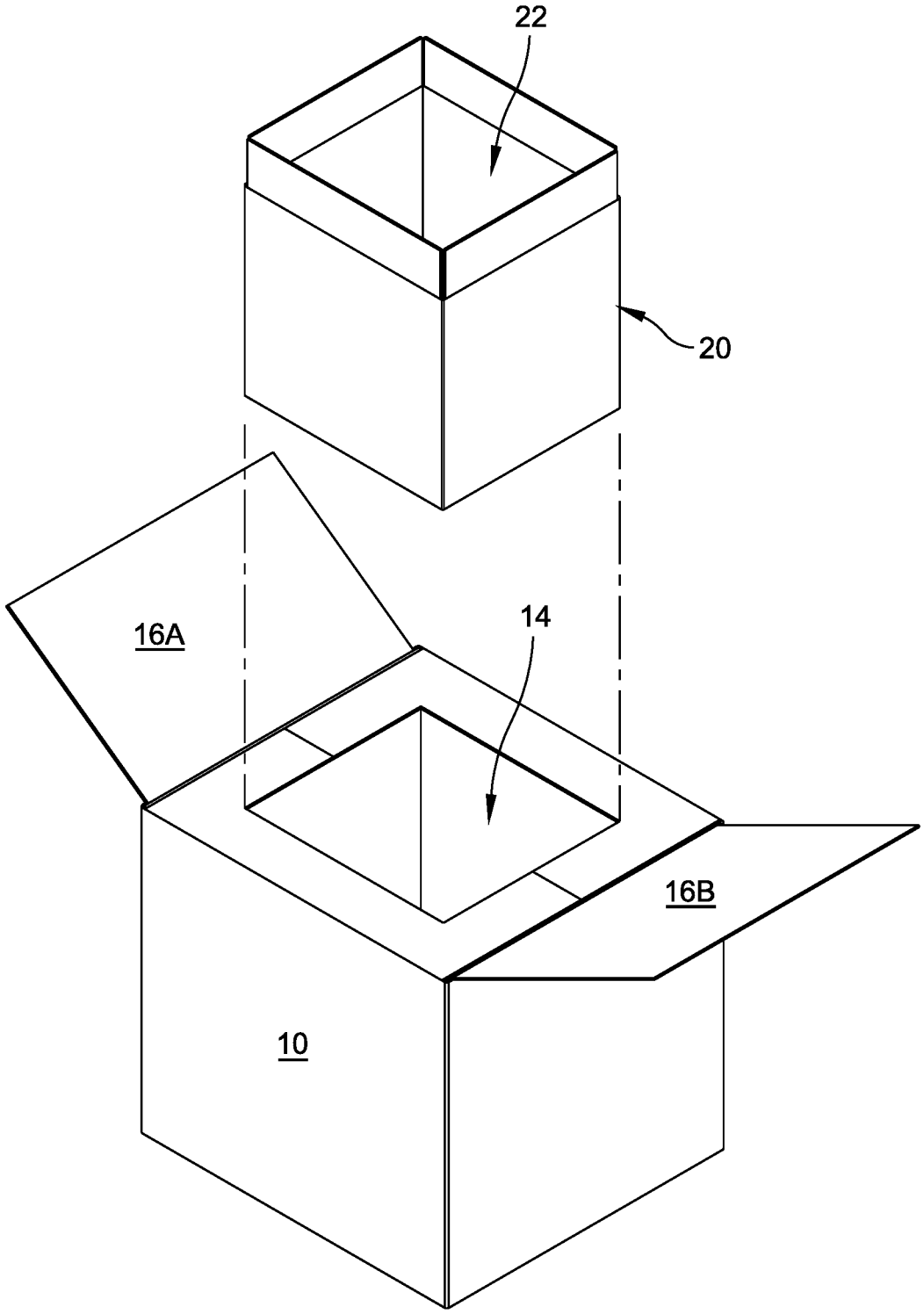
FIG. 8 is a perspective view illustrating both the outer box structure and the inner box structure, illustrating the positioning of the inner box structure into the cavity of the outer box structure.
Figure 9:
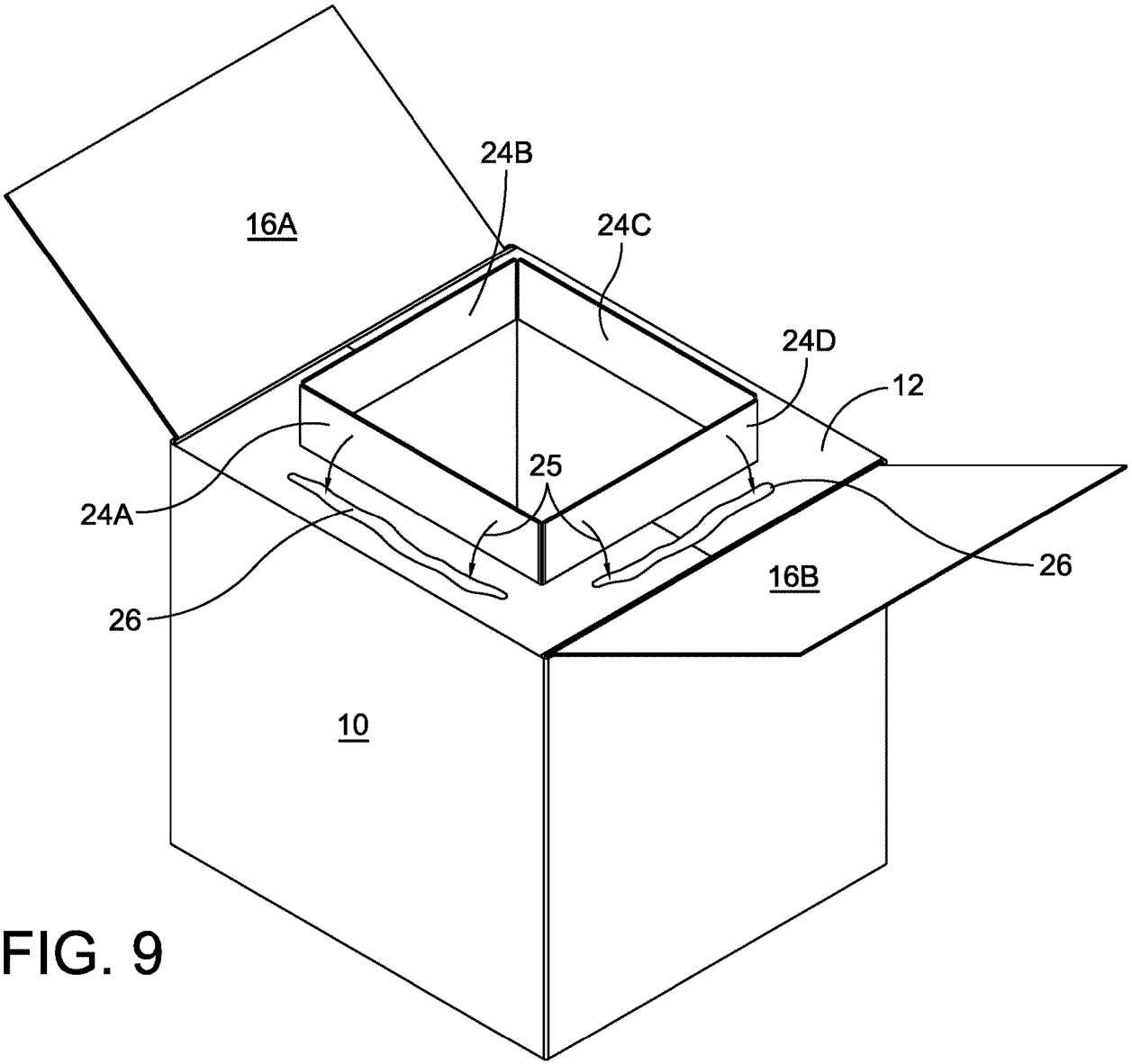
FIG. 9 is a perspective view illustrating the inner box structure and its associated folds.
Figure 10:
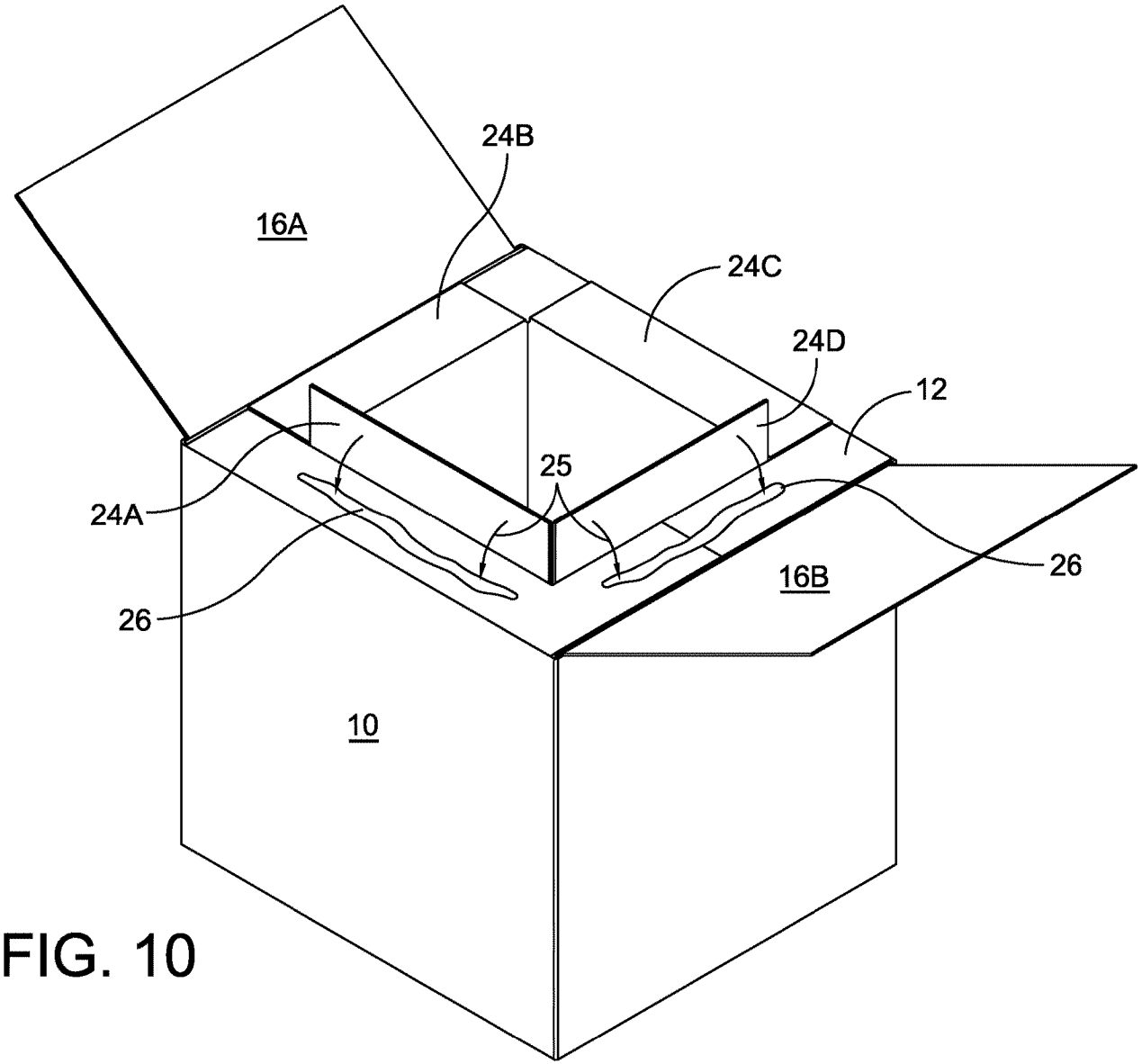
FIG. 10 is a perspective view showing two of the folds of the inner box structure sealed against the top wall of the outer box structure.
Figure 11:
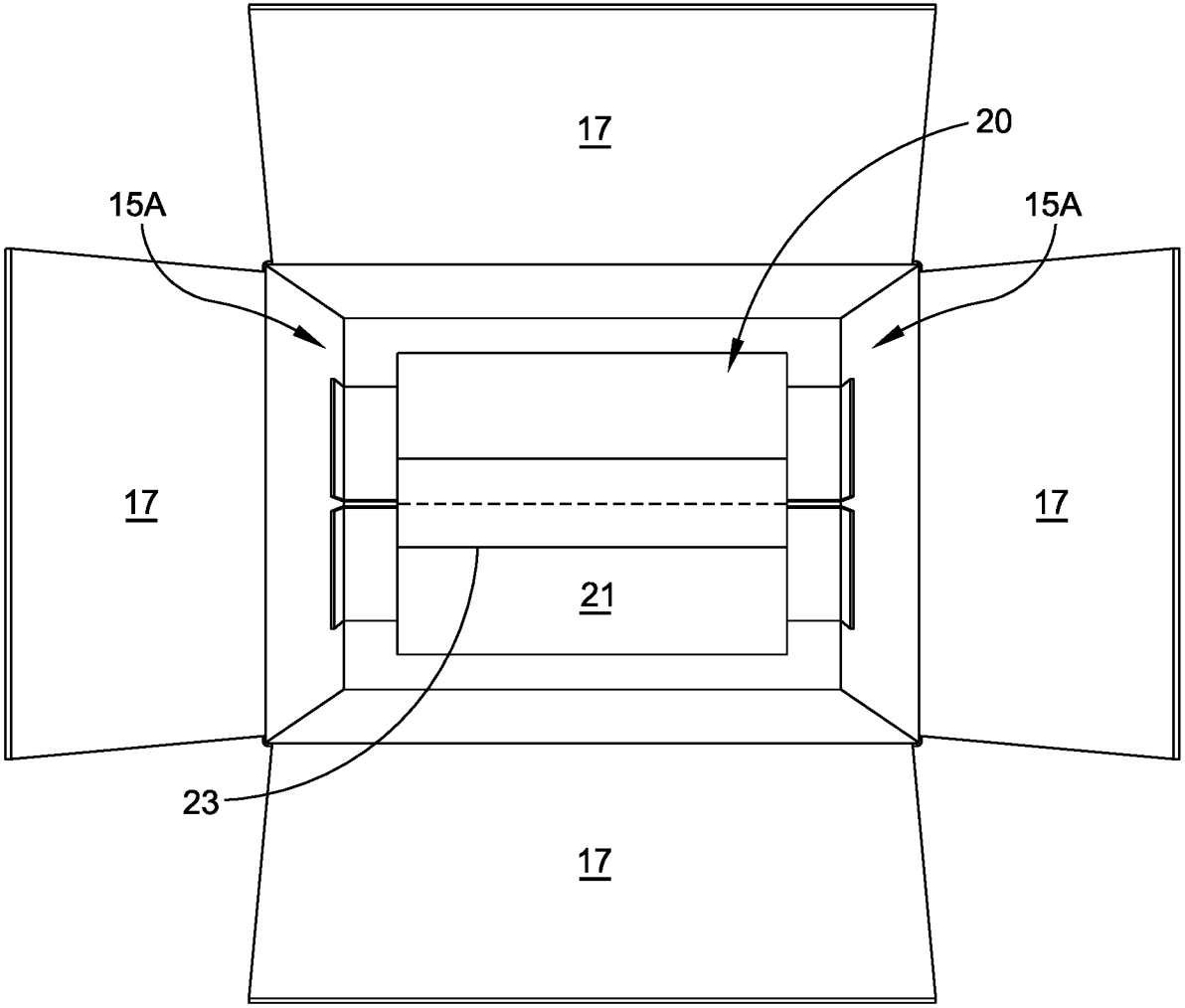
FIG. 11 is a bottom view of the assembled inner and outer box structures.
Figure 12:
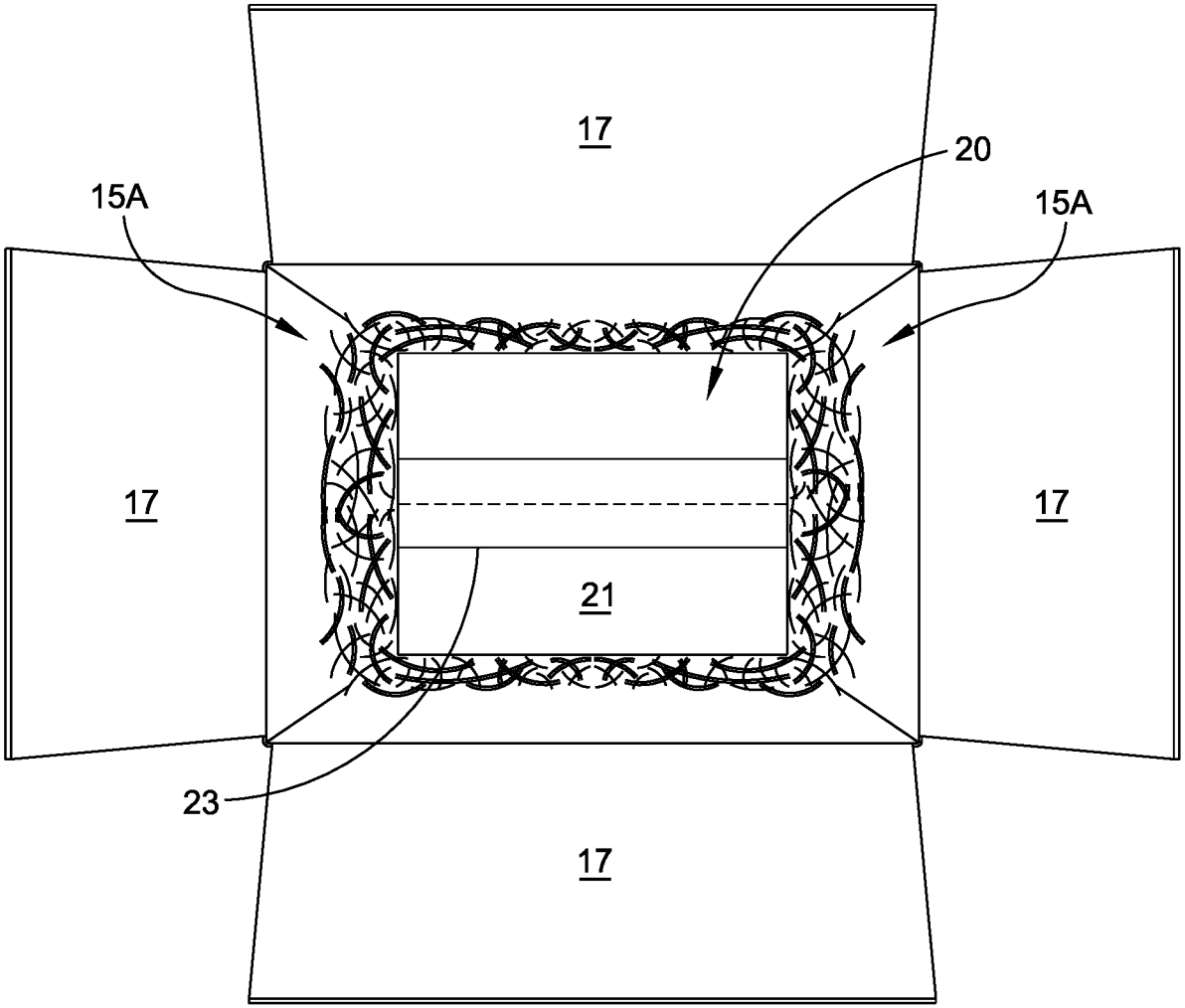
FIG. 12 is a bottom view illustrating the filling of the space between the respective inner and outer box structures by the wheat straw material.
Figure 13:
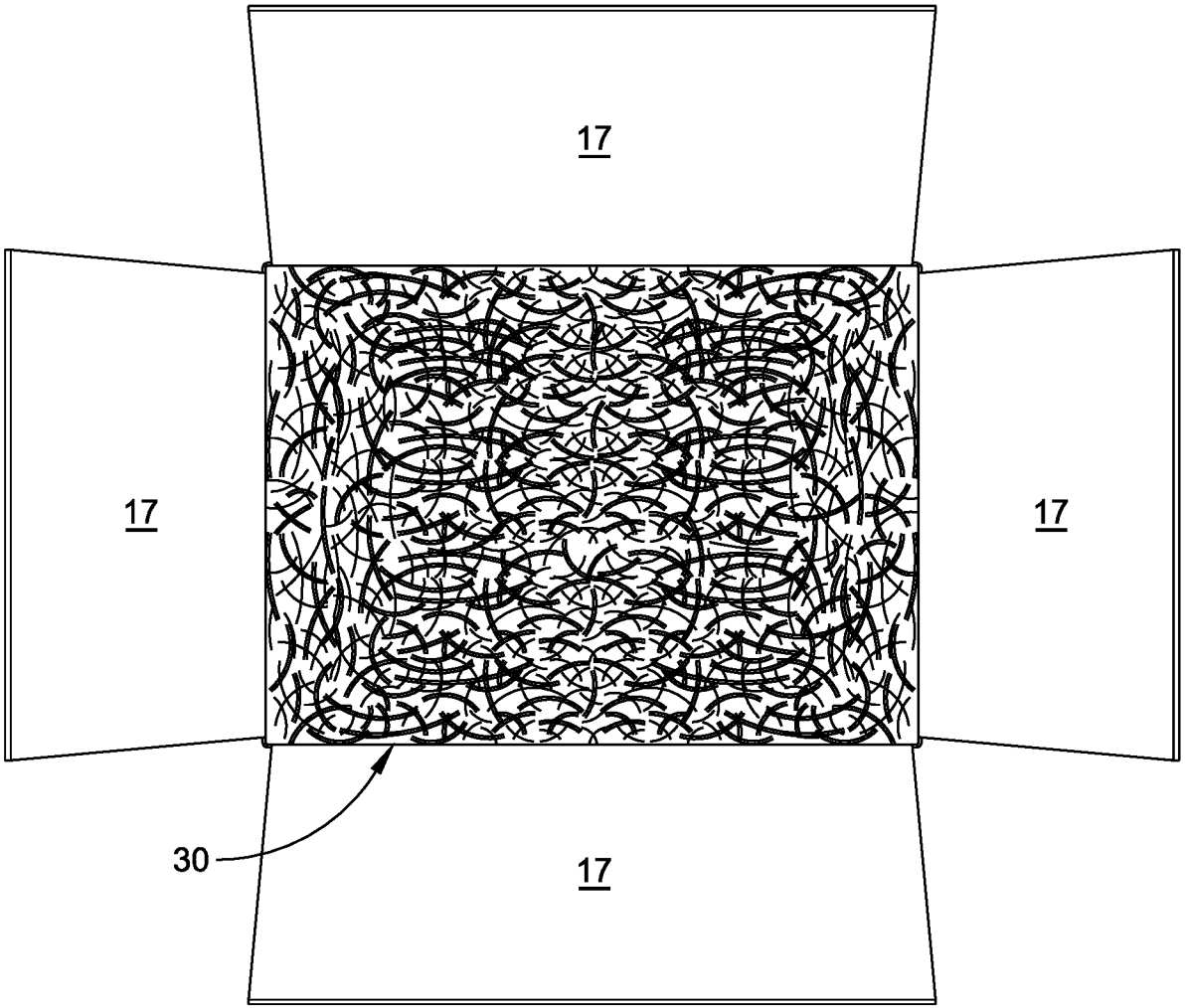
FIG. 13 is a bottom view illustrating the entire bottom of the container being filled with the wheat straw material.
Figure 14:
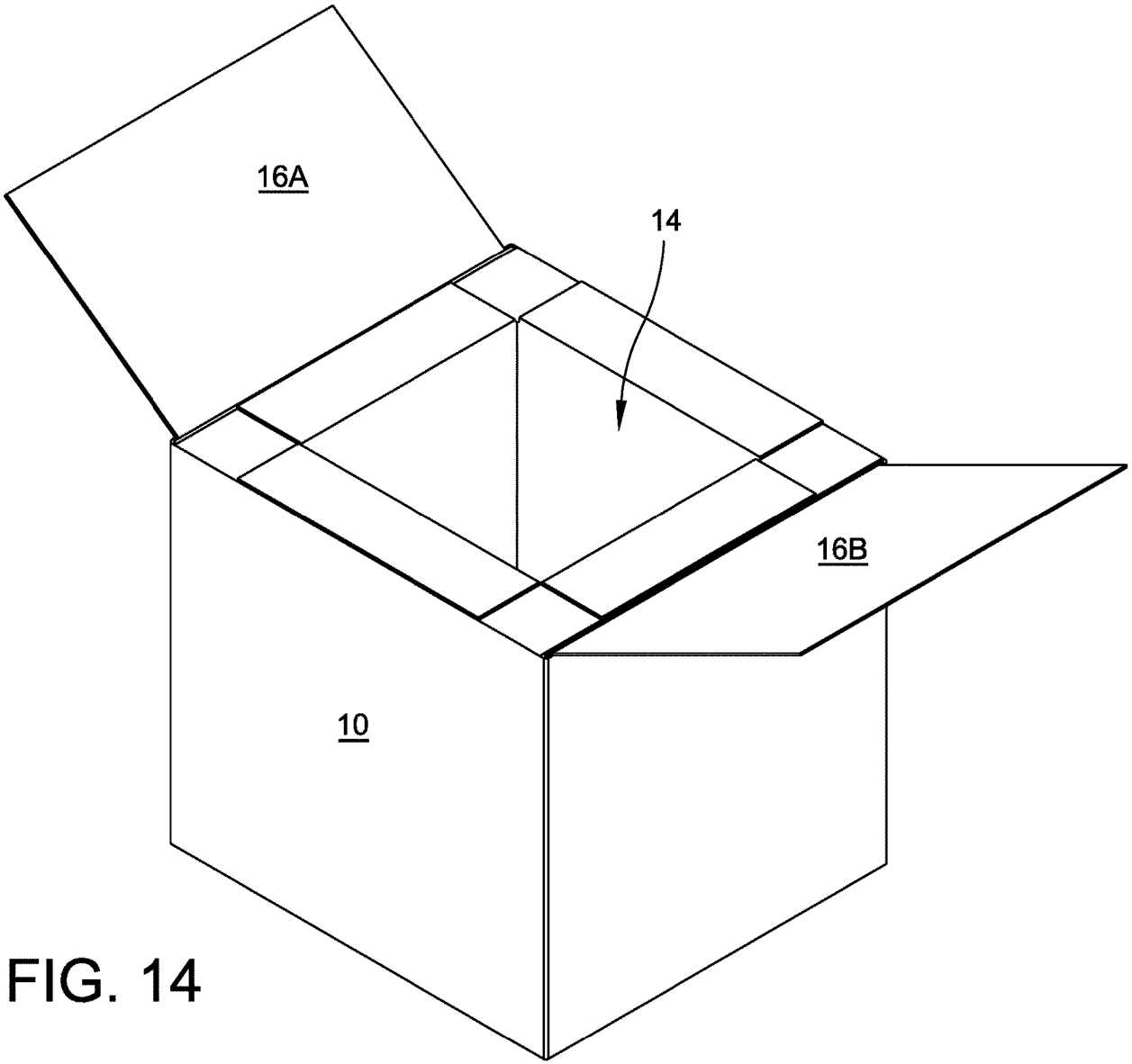
FIG. 14 is a perspective view illustrating the open passage in the inner box structure.

Reference is now made to FIGS. 6 and 7. FIG. 6 is a top perspective view illustrating the inner box structure 20. The inner box structure may also be constructed of a standard cardboard material; or possibly other materials that are preferably bio-degradable. FIG. 7 is a bottom perspective view illustrating the bottom wall 21 which is comprised of folded in pieces and a tape illustrated at 23 in FIG. 7. In the top perspective view of FIG. 6, the inner box structure 20 is provided with four flaps illustrated at 24A-24D. FIG. 8 illustrates the inner box structure 20 positioned for insertion within the cavity 14 of the outer box structure 10. Reference is now made to FIGS. 9 and 10. These respective views illustrate the manner in which the flaps 24A-24D are folded against the top wall 12. FIG. 9 illustrates glue spots at 26. FIG. 10 illustrates two of the flaps 24B, 24C having been folded down against a glue spot. In FIG. 10 the folds 24A, 24D are shown in position about to be folded against the glue spots 26. FIG. 11 is a bottom view illustrating the inner box structure 20 with a space being provided on all four sides between inner surfaces of the outer box structure and outer surfaces of the inner box structure. FIG. 12 is a bottom view illustrating the wheat straw at 30 being positioned between the inner and outer box structures. FIG. 13 is a bottom view illustrating the entire container having been filled with the wheat straw material. This is accomplished with the container in an upside down position. FIG. 14 is a perspective view that simply illustrates the final positioning of the inner and outer box structures prior to insertion of the item, the temperature of which is being controlled.

Figure 15:
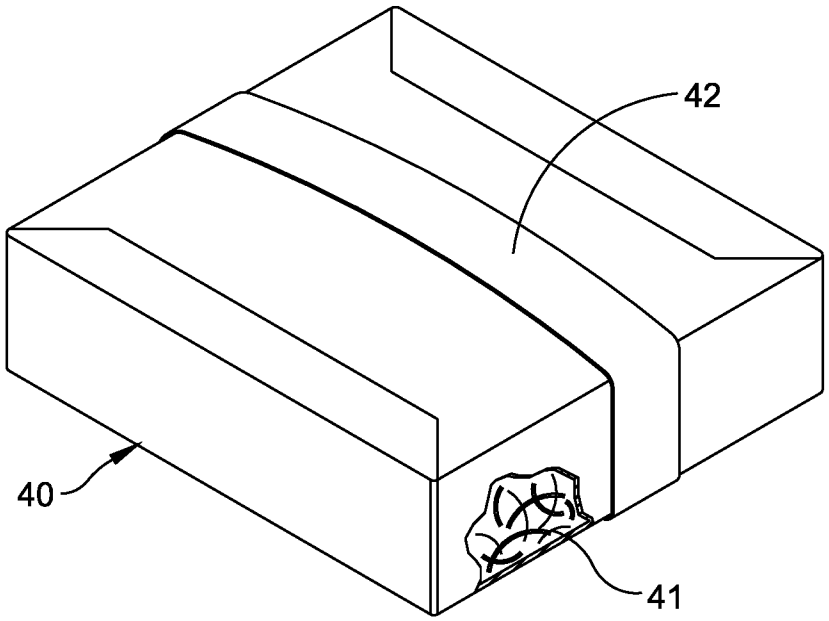
FIG. 15 is a top perspective view of the insert of the present invention.
Figure 16:
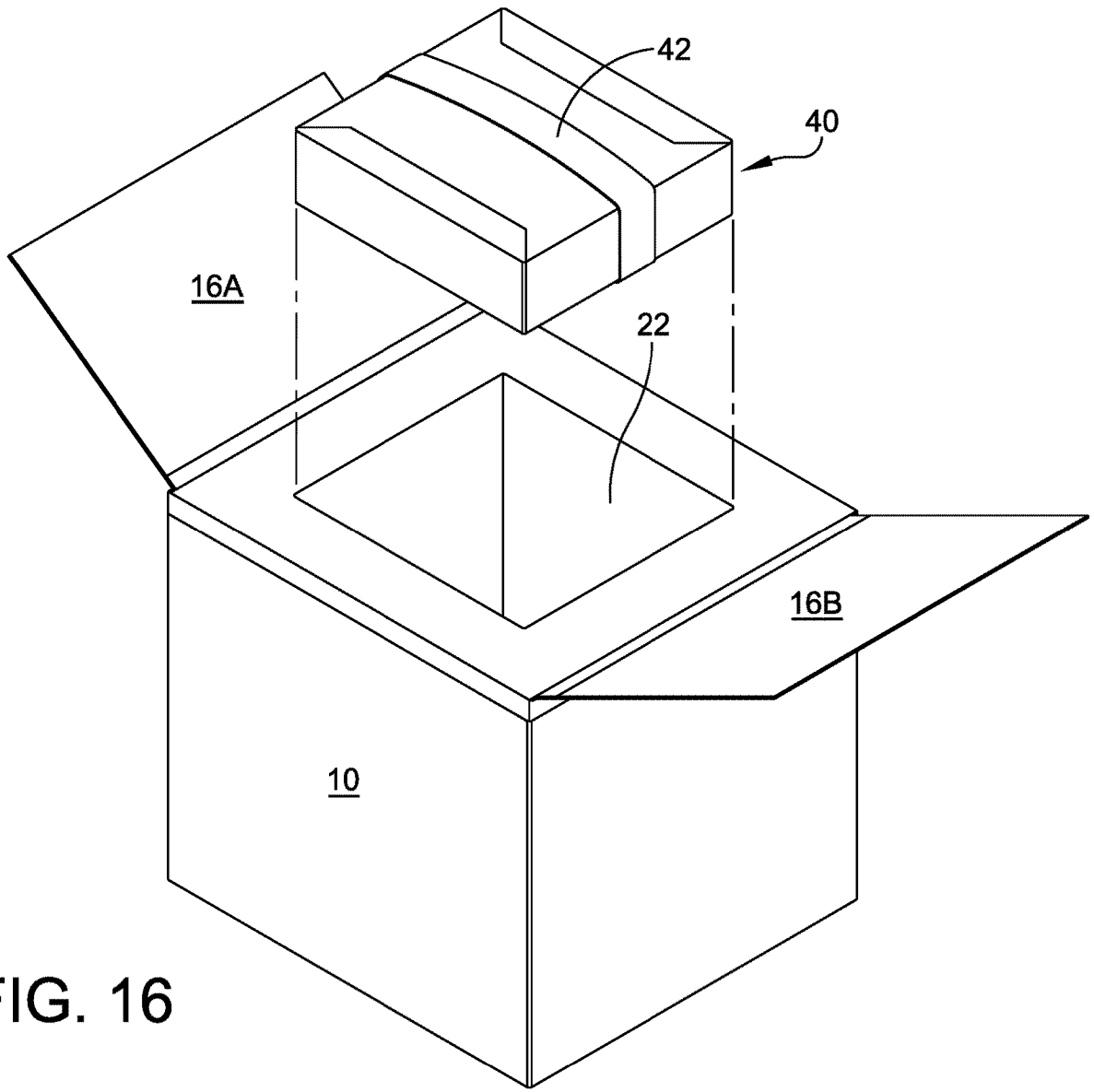
FIG. 16 is a perspective view showing the insert as engaged with the open passage of the container.
Figure 17:
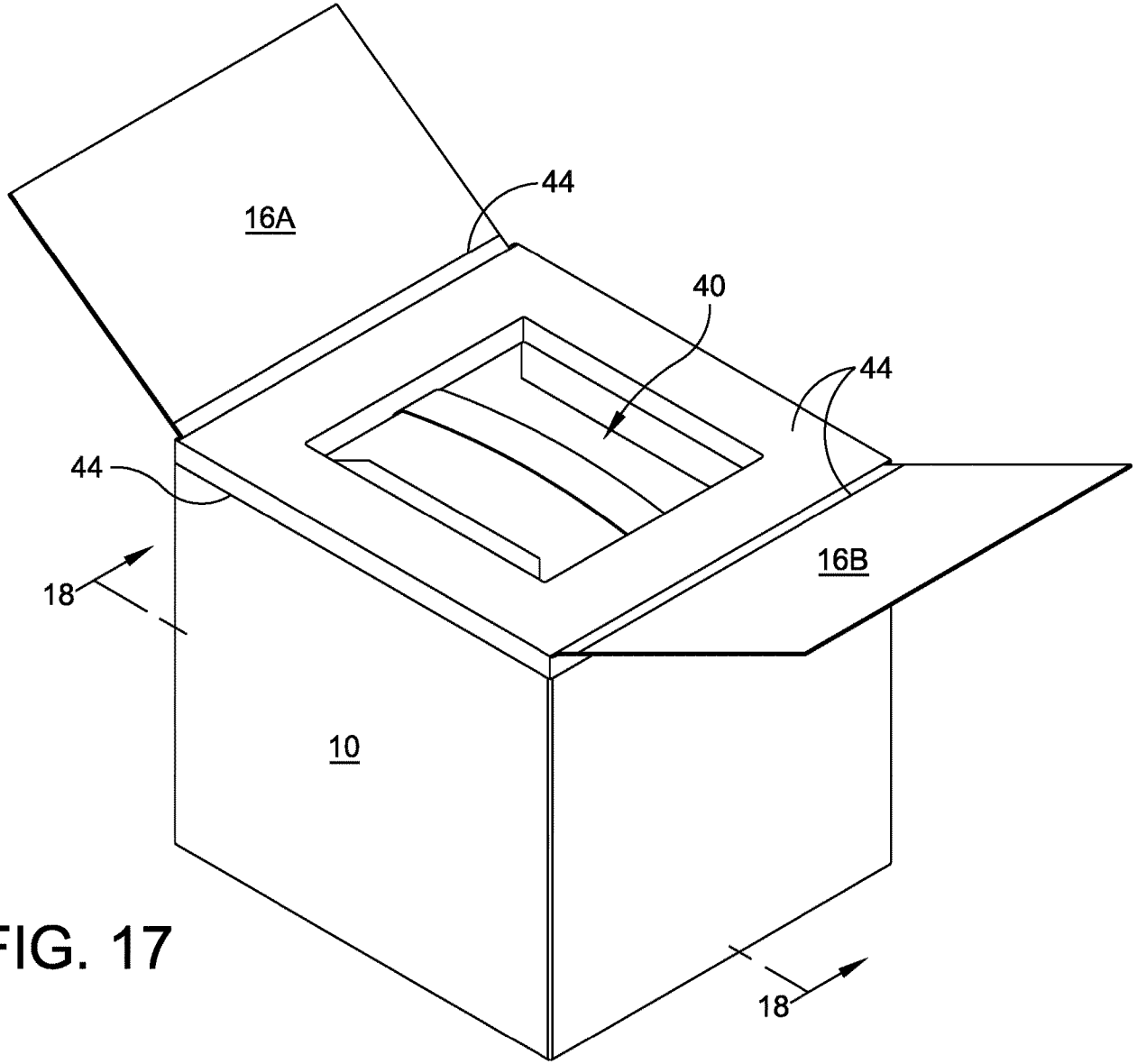
FIG. 17 is a perspective view showing the insert engaged in position.

FIG. 15 is a perspective view of the insert of the present invention. This insert is hollow but contains the wheat straw illustrated at 30 in FIG. 15. The insert 40 also preferably includes a loop strap 42. FIG. 16 is a perspective view illustrating the insert 40 about to be positioned within the open passage 22 of the inner box structure 20. FIG. 17 illustrates the insert 40 in position within the open passage 22.

Figure 18:
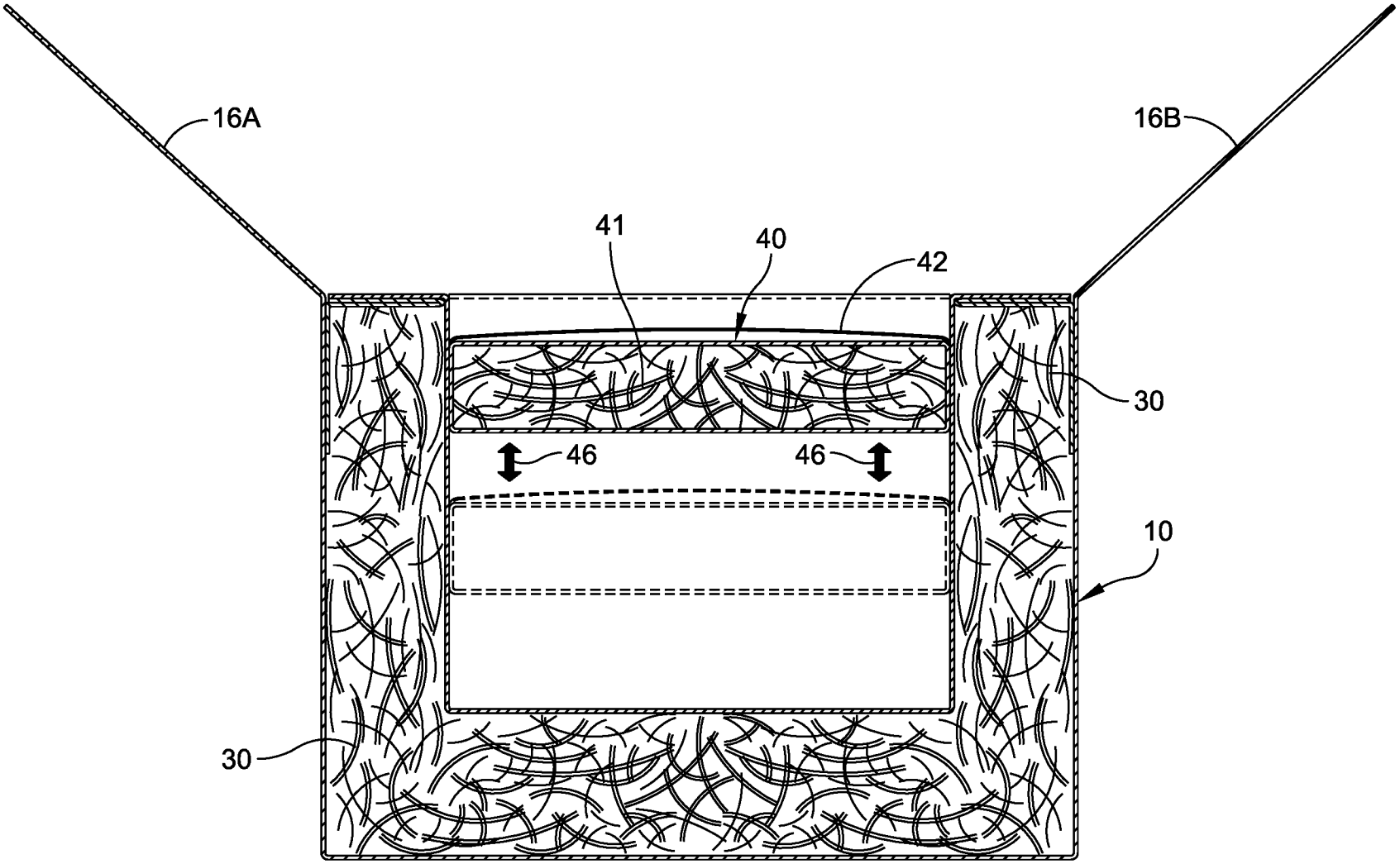
FIG. 18 is a cross-sectional view taken along line 18-18 of FIG. 17.

FIGS. 18-21 are cross-sectional views that clearly illustrate different positions that the insert 40 can be maintained. In FIG. 18 the arrows 46 illustrate the different positions height wise that the insert 40 can assume. The cross-sectional view of FIG. 19 illustrates the insert 40 being positioned within the open passage 22 over and preferably contacting the item 50 which is simply shown as a block representing the item, the temperature of which is being controlled. FIG. 20 simply illustrates the insert 40 at a different lower position corresponding to the reduced height of a smaller item 50. FIG. 21 illustrates still a larger item 50 and the corresponding position of the insert 40.

Figure 22:
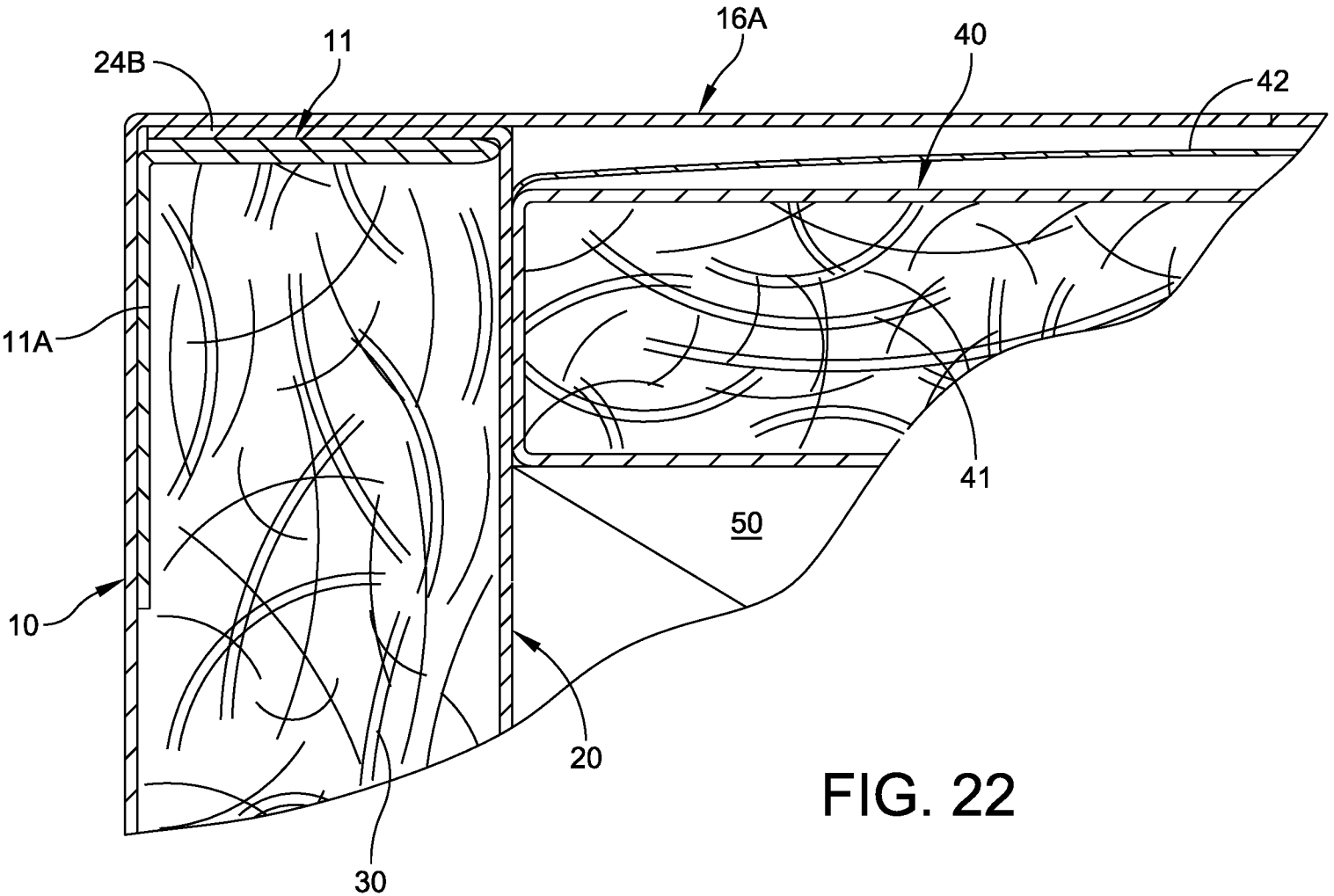
FIG. 22 is a fragmentary view at a corner of the container.

FIG. 22 is a fragmentary view taken at a corner of the container clearly illustrating the manner in which the insulating wheat straw completely surrounds the item while the insert 40 maintains a further insulation material at the top of the item.

Figure 23:
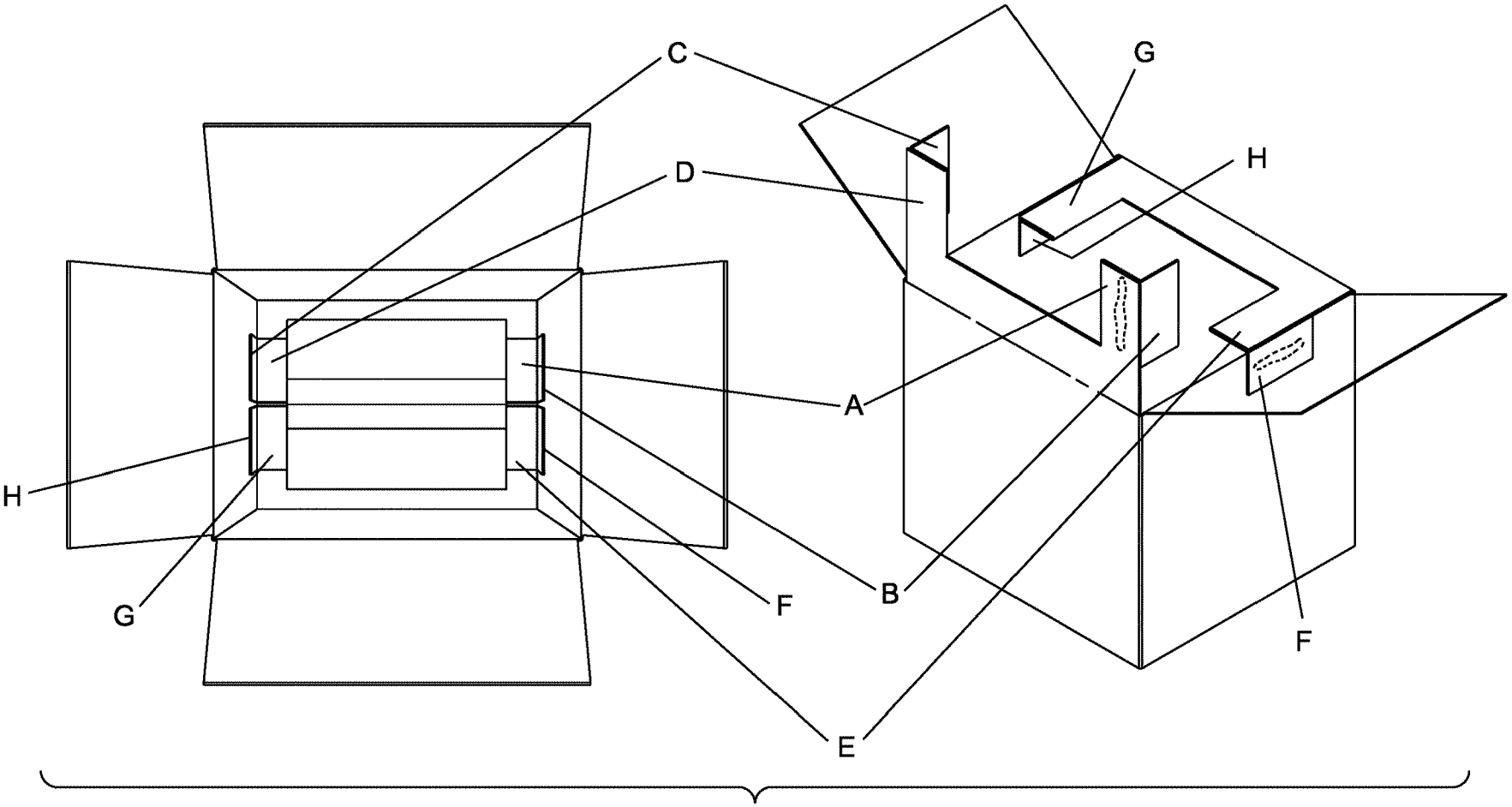
FIG. 23 is a comparison diagram relating to FIGS. 4 and 11 for an illustration of the corresponding folds A-G.

FIG. 23 is a comparative view relating to the bottom view of FIG. 11 and the perspective top view of FIG. 4 as far as the various folds are concerned. These are identified in FIG. 23 as folds A-H.

The following is a list of reference numbers used in the description.

REFERENCE NUMBERS

10 outer box structure
11 doubled over fold
11A side tab
12 top wall
13 arrows
14 cavity
15A, 15B side and bottom spaces (for straw)
16A flap
16B opposed top flap
17 bottom flaps
18A-18B opposed side flaps
19 glue spot
20 inner box structure
21 bottom wall
22 open passage
23 tape at bottom wall
24A-22D four flaps of inner box structure
25 arrows
26 glue spot
30 wheat straw
40 insert
41 wheat straw in insert
42 loop handle
44 tape
46 arrows
50 item being temperature controlled

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A temperature-controlled container comprising:

an outer box structure including a top wall that defines an inner cavity;

said top wall formed by opposed pairs of flaps, (16A, 16B, and 18A, 18B); each of the flaps (18A and 18B) having a cut-out section that together define a rectangular opening into the inner cavity;

the cut-out sections being each formed by the following respective folds A, B; C, D; E, F; and G, H;

the folds B, C, F and H defining securing tabs;

a glue spot between each of the tabs B, C, F, and H and respective inner sides of the outer box structure;

an inner box structure that is constructed and arranged for engagement into the cavity that is formed in the outer box structure;

said inner box structure having an open passage for accommodating an item the temperature of which is to be controlled;

said inner box structure having a height that is less than a height of the outer box structure so as to define an open space between a bottom of the inner box structure and a bottom of the outer box structure;

the inner box structure including opposed pairs of top side flaps (24A, 24C and 24B, 24D) that are each adapted to be folded over for securing to the formed top wall of the outer box structure;

and a glue spot between each of the top side flaps and the formed top wall of the outer box structure; and a wheat straw material that is disposed in the outer box structure between respective sidewalls of the outer box structure and the inner box structure, and that is disposed in the open space between a bottom of the inner box structure and a bottom of the outer box structure.

2. The temperature-controlled container of claim 1 wherein the outer box structure is in the form of a hexahedron and has a pair of opposed flaps.

3. The temperature-controlled container of claim 2 wherein the inner box structure is in the form of a hexahedron and has four flaps.

4. The temperature-controlled container of claim 3 wherein the pair of opposed flaps of the outer box structure are closed against a top of the outer box structure that defines the cavity.

5. The temperature-controlled container of claim 4 wherein the four flaps of the inner box structure are disposed in two opposed sets that are foldable against and sealed with the top of the outer box structure that defines the cavity.

6. The temperature-controlled container of claim 5 further including a multi-sided insert that is constructed and arranged for insertion into the open passage and over the item the temperature of which is to be controlled.

7. The temperature-controlled container of claim 6 wherein the insert is hollow and contains an amount of wheat straw.

8. The temperature-controlled container of claim 1 further including a multi-sided insert that is constructed and arranged for insertion into the open passage and over the item the temperature of which is to be controlled.

9. The temperature-controlled container of claim 8 wherein the insert is hollow and contains an amount of wheat straw.

10. The temperature-controlled container of claim 9 wherein the insert fits within the open passage with a tight but slidable fit so as to be adjustable in position relative to the item the temperature of which is to be controlled.

11. A temperature-controlled container comprising:

an outer box structure that includes a top wall that defines an inner cavity;

said top wall formed by opposed pairs of flaps, (16A, 16B, and 18A, 18B); each of the flaps (18A and 18B) having a cut-out section that together define a rectangular opening into the inner cavity;

the cut-out sections being each formed by the following respective folds A, B; C, D; E, F; and G, H;

the folds B, C, F and H defining tabs for securing to respective inner sides of the outer box structure;

an inner box structure that is constructed and arranged for engagement into the cavity that is formed in the top wall of the outer box structure;

said inner box structure having a series of top flaps (24A, 24C and 24B, 24D) that are bendable for securing to the top wall of the outer box structure;

said inner box structure having an open passage for accommodating an item the temperature of which is to be controlled;

said inner box structure having a height that is less than a height of the outer box structure so as to define an open space between a bottom of the inner box structure and a bottom of the outer box structure;

a wheat straw material that is disposed in the outer box structure between respective sidewalls of the outer box structure and the inner box structure, and that is disposed in the open space between a bottom of the inner box structure and a bottom of the outer box structure;

a multi-sided insert that is constructed and arranged for insertion into the open passage and over the item the temperature of which is to be controlled;

wherein the insert is hollow and contains an amount of wheat straw; and wherein the insert fits within the open passage with a tight but slidable fit so as to be adjustable in position relative to the item the temperature of which is to be controlled.

12. The temperature-controlled container of claim 11 including a glue spot that is disposed between each of the tabs B, C, F, and H and respective inner sides of the outer box structure.

13. The temperature-controlled container of claim 12 wherein the pair of opposed flaps of the outer box structure are closed against a top of the outer box structure that defines the cavity.

14. The temperature-controlled container of claim 13 including a glue spot between each of the top side flaps (24A, 24C and 24B, 24D) and the formed top wall of the outer box structure.

15. The temperature-controlled container of claim 11 including a glue spot between each of the top side flaps (24A, 24C and 24B, 24D) and the formed top wall of the outer box structure.

16. A method of packaging an item the temperature of which is to be controlled using a temperature-controlled container comprising the steps of:

providing an outer box structure that includes a top wall that in part defines an inner cavity;

providing said top wall formed by opposed pairs of flaps, (16A, 16B, and 18A, 18B); each of the flaps (18A and 18B) having a cut-out section that together define a rectangular opening into the inner cavity;

providing an inner box structure;

providing the inner box structure including opposed pairs of top side flaps (24A, 24C and 24B, 24D) that are each adapted to be folded over for securing to the formed top wall of the outer box structure;

and a glue spot between each of the top side flaps and the formed top wall of the outer box structure; and engaging the inner box structure for engagement into the cavity that is formed in top wall of the outer box structure;

said inner box structure having an open passage for accommodating the item the temperature of which is to be controlled;

said inner box structure having a height that is less than a height of the outer box structure so as to define an open space between a bottom of the inner box structure and a bottom of the outer box structure; and filling wheat straw material into the container and that is disposed in the outer box structure between respective sidewalls of the outer box structure and the inner box structure, and that is disposed in the open space between a bottom of the inner box structure and a bottom of the outer box structure.

17. The method of claim 16 including providing a multi-sided insert that is constructed and arranged for insertion into the open passage and over the item the temperature of which is to be controlled.

18. The method of claim 17 wherein the insert is hollow and filling an amount of wheat straw into the insert.

19. The method of claim 18 including fitting the insert within the open passage with a tight but slidable fit so as to be adjustable in position relative to the item the temperature of which is to be controlled.

20. The method of claim 16 wherein the cut-out sections are each formed by the following respective folds A, B; C, D; E, F; and G, H; and the folds B, C, F and H define tabs for securing to respective inner sides of the outer box structure.

* * * * *